US009326556B2

(12) United States Patent
Leon

(10) Patent No.: US 9,326,556 B2
(45) Date of Patent: May 3, 2016

(54) PERSONAL COOLING ASSEMBLY

(71) Applicant: Frank Leon, Miami, FL (US)

(72) Inventor: Frank Leon, Miami, FL (US)

( * ) Notice: Subject to any disclaimer, the term of this patent is extended or adjusted under 35 U.S.C. 154(b) by 117 days.

(21) Appl. No.: 14/328,171

(22) Filed: Jul. 10, 2014

(65) Prior Publication Data

US 2016/0007661 A1 Jan. 14, 2016

(51) Int. Cl.
*A41D 13/05* (2006.01)
*A41D 13/005* (2006.01)

(52) U.S. Cl.
CPC ..... *A41D 13/0053* (2013.01)

(58) Field of Classification Search
CPC ..... A41D 13/0053; A41D 13/005; A41D 13/0058; A41D 13/0158; A41D 13/055; A41D 13/05
USPC ..... 62/259.3; 222/1, 81; 455/90.1, 90.3
See application file for complete search history.

(56) References Cited

U.S. PATENT DOCUMENTS 3,112,792 A * 12/1963 Coleman, Jr. ..... A41D 13/005 165/108
6,778,394 B2 * 8/2004 Oikawa ..... F28D 15/0266 165/104.26
6,942,015 B1 * 9/2005 Jenkins ..... A41D 13/005 165/104.14
7,782,613 B2 8/2010 Harris
8,012,248 B2 * 9/2011 Yun ..... B01D 45/14 96/244
D671,933 S 12/2012 Rodgers
8,477,490 B2 7/2013 Fletcher
8,715,587 B1 * 5/2014 Downs ..... A61L 9/00 422/306
2002/0152969 A1 * 10/2002 Grigsby ..... A01K 1/033 119/500
2003/0029918 A1 * 2/2003 Leanheart ..... G09F 27/00 235/462.13
2004/0235430 A1 11/2004 Ma et al.
2007/0113421 A1 * 5/2007 Uhara ..... D06F 25/00 34/275
2011/0049259 A1 * 3/2011 Beland ..... A61L 9/032 239/7
2011/0134604 A1 * 6/2011 Attlesey ..... G06F 1/20 361/679.47
2011/0194252 A1 8/2011 Wang
2011/0292616 A1 * 12/2011 Snider ..... H04B 1/082 361/724
2012/0031275 A1 * 2/2012 Yun ..... B01D 45/14 96/309
2013/0308678 A1 * 11/2013 Bach ..... G01K 13/02 374/142
2013/0344609 A1 12/2013 Mayer et al.

FOREIGN PATENT DOCUMENTS

EP 2518586 10/2012

* cited by examiner

*Primary Examiner* — Mohammad M Ali

(57) ABSTRACT

A personal cooling assembly includes a housing. A distal edge of a perimeter wall of the housing relative to the back wall of the housing defines an opening into the housing. The housing may insertably receive an electronic device. A plurality of intakes extends through the back wall. The housing includes a plurality of ducts. The plurality of ducts each has a first end and a second end. Each of the ducts extends through the perimeter wall. The first end of each of the ducts is in fluid communication with at least one of the intakes. The second end of each of the ducts is directed outwardly from the housing. A motor is coupled to the housing. A fan is coupled to the motor. The motor rotates the fan. The fan urges air inwardly through the plurality of intakes and outwardly through the second end of the plurality of ducts.

13 Claims, 6 Drawing Sheets

PERSONAL COOLING ASSEMBLY

BACKGROUND OF THE DISCLOSURE

Field of the Disclosure

The disclosure relates to cooling devices and more particularly pertains to a new cooling device for being coupled to an electronic device such that a user may cool themselves while using the electronic device.

SUMMARY OF THE DISCLOSURE

An embodiment of the disclosure meets the needs presented above by generally comprising a housing. The housing includes a back wall and a perimeter wall coupled to the back wall. A distal edge of the perimeter wall relative to the back wall defines an opening into the housing. The housing may insertably receive an electronic device. A plurality of intakes extends through the back wall. The housing is structured to define a plurality of ducts. The plurality of ducts each has a first end and a second end. Each of the ducts extends through the perimeter wall. The first end of each of the ducts is in fluid communication with at least one of the intakes. The second end of each of the ducts is directed outwardly from the housing. A motor is coupled to the housing. A fan is coupled to the motor. The motor rotates the fan so the fan urges air inwardly through the plurality of intakes and outwardly through the second end of the plurality of ducts.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
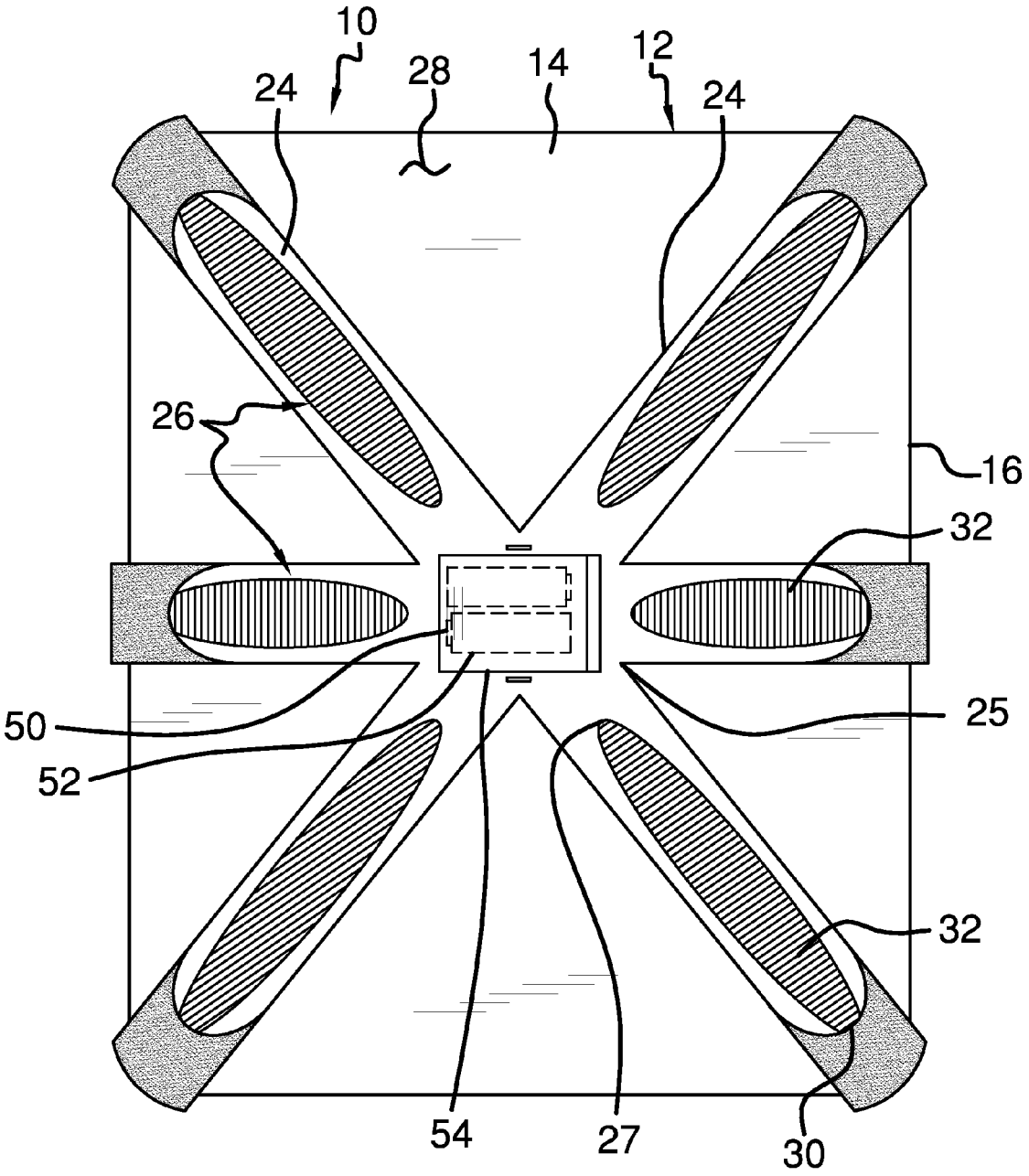
FIG. 1 is a back view of a personal cooling assembly according to an embodiment of the disclosure.
Figure 2:
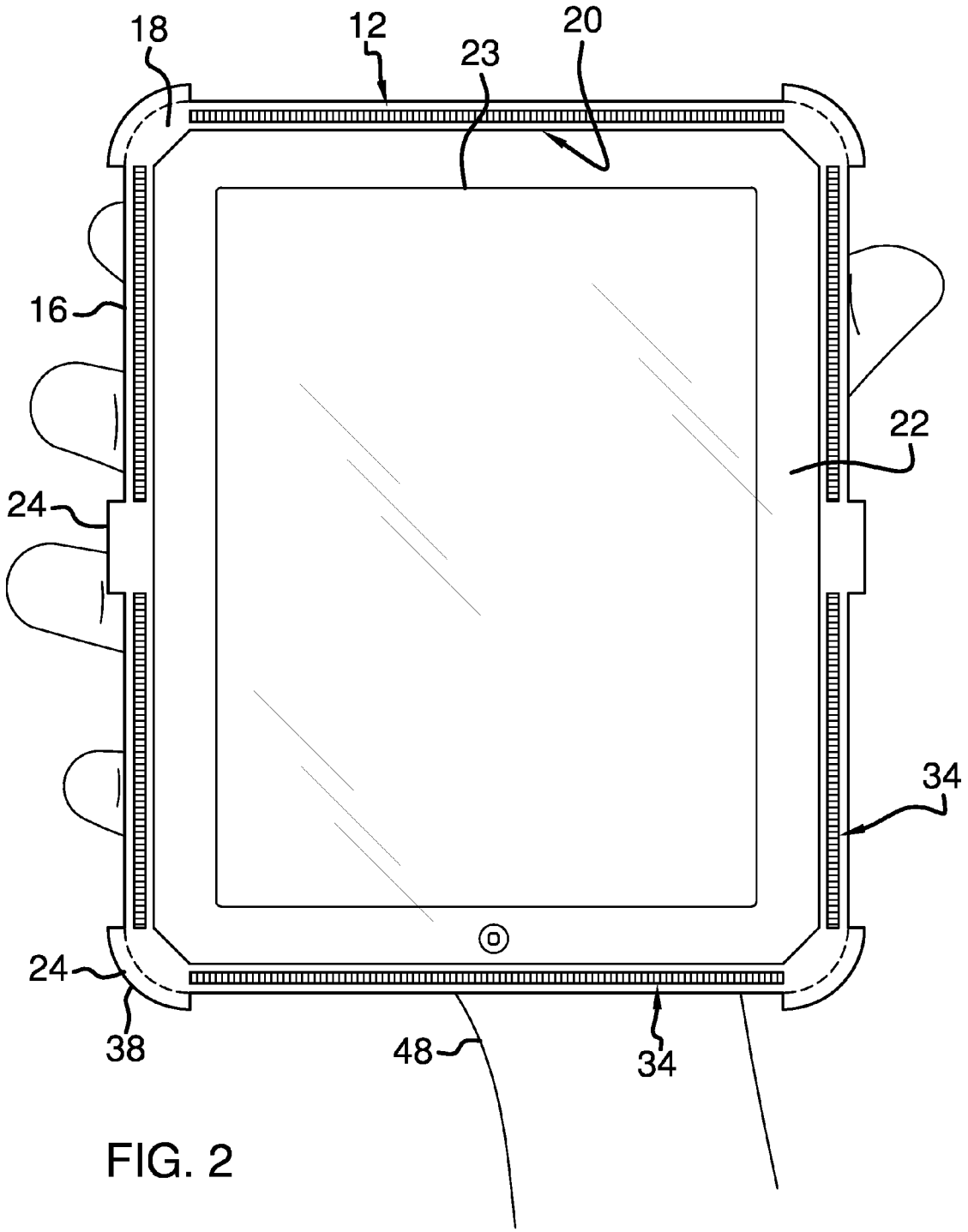
FIG. 2 is a front view of an embodiment of the disclosure.
Figure 3:
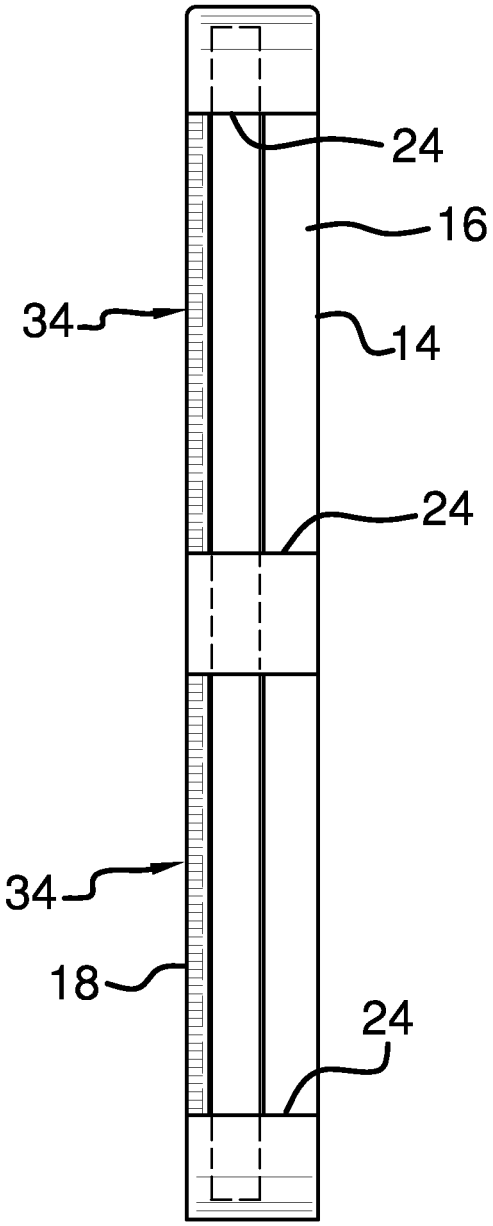
FIG. 3 is a right side view of an embodiment of the disclosure.
Figure 4:
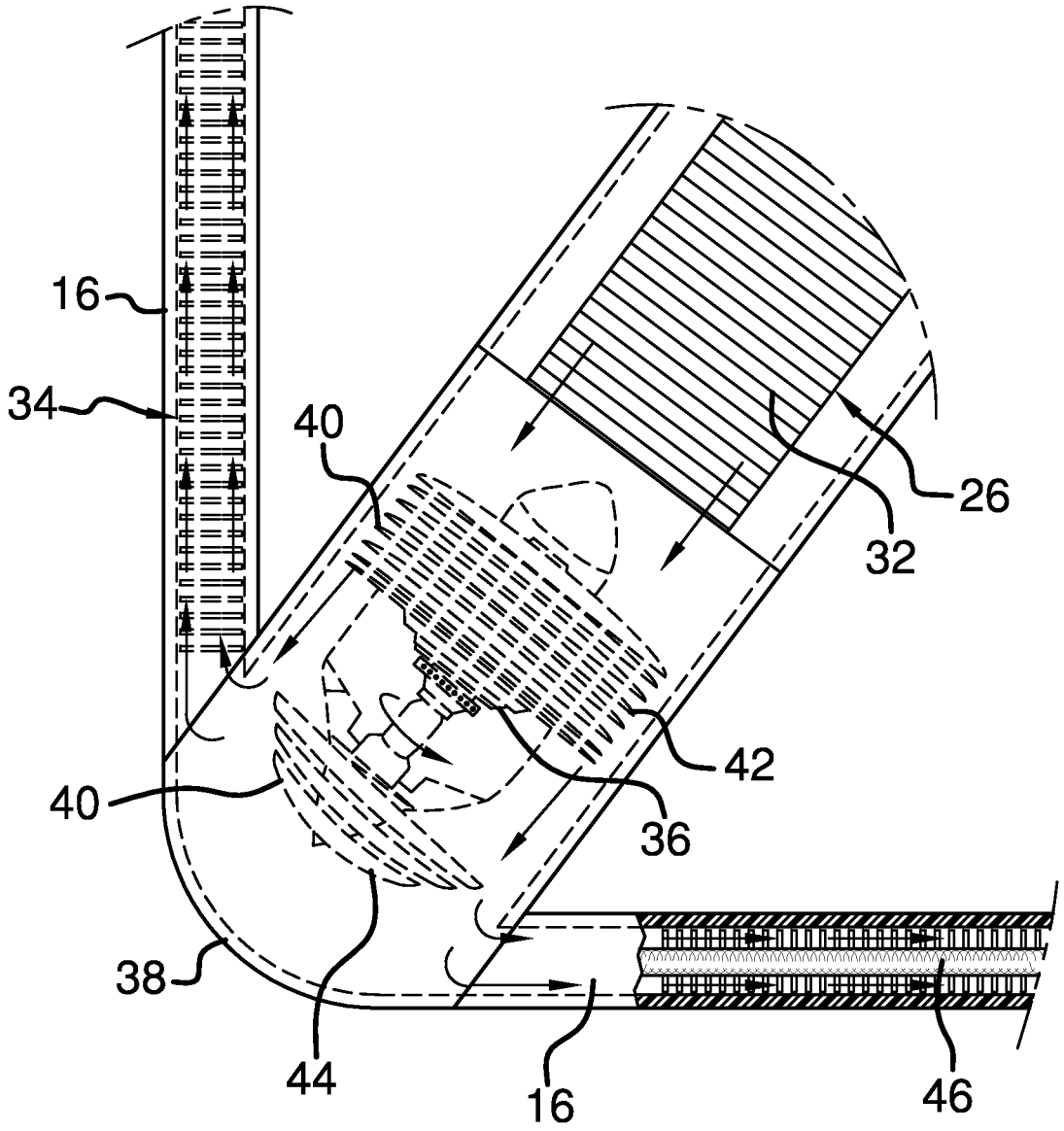
FIG. 4 is a phantom view of a back side of an embodiment of the disclosure.
Figure 5:
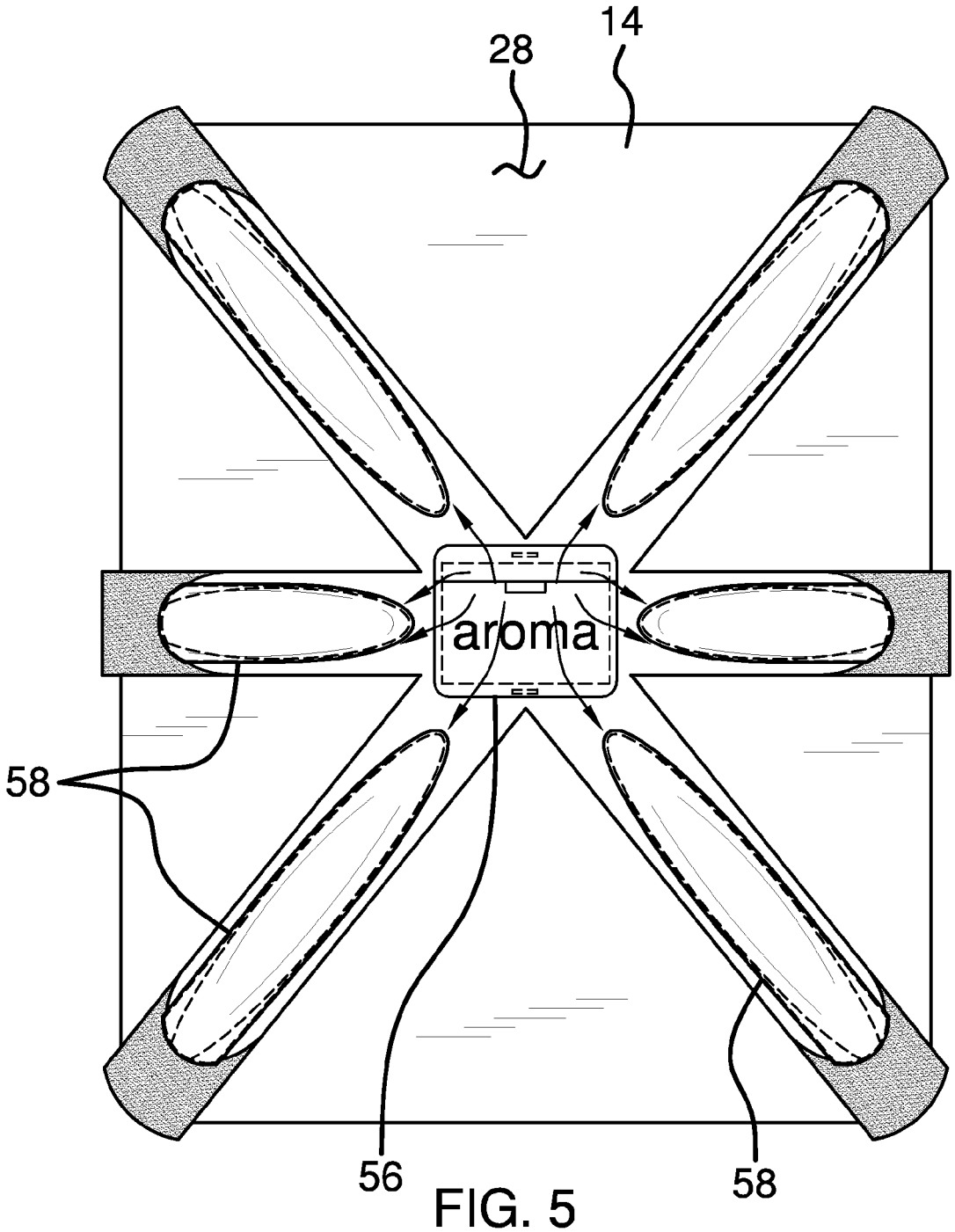
FIG. 5 is a back view of an alternative embodiment of the disclosure.
Figure 6:
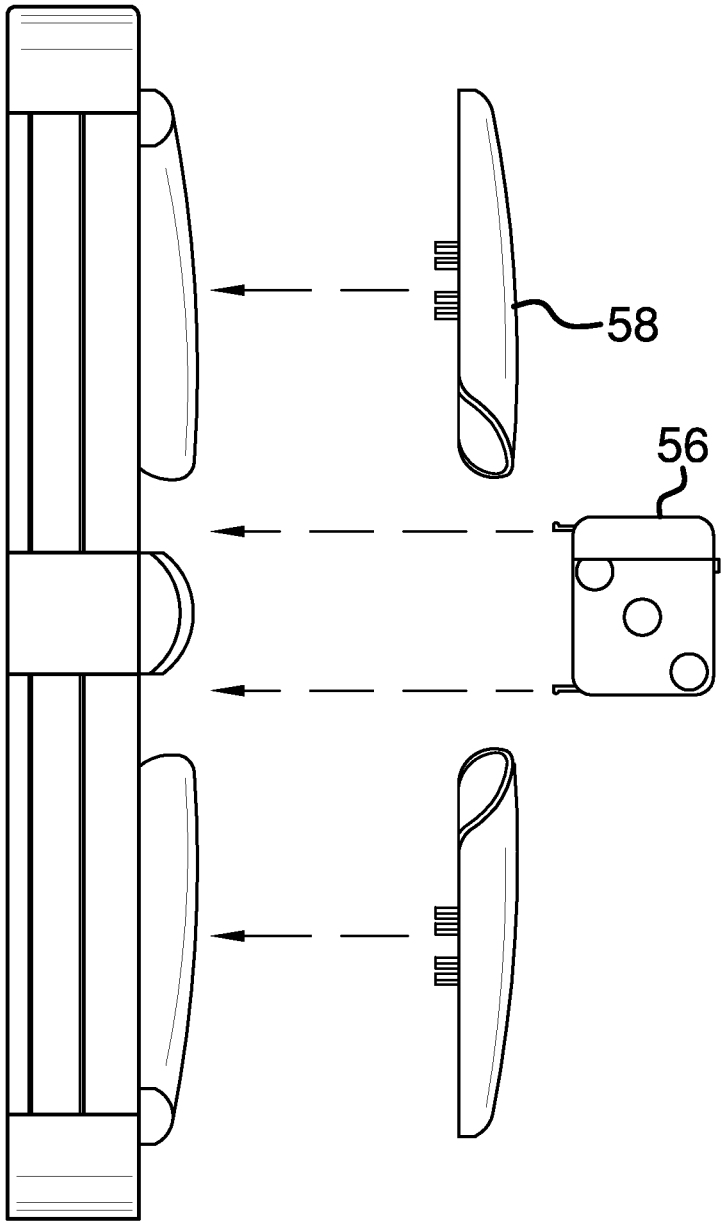
FIG. 6 is a right side view of an alternative embodiment of the disclosure.

With reference now to the drawings, and in particular to FIGS. 1 through 6 thereof, a new cooling device embodying the principles and concepts of an embodiment of the disclosure and generally designated by the reference numeral 10 will be described.

As best illustrated in FIGS. 1 through 6, the personal cooling assembly 10 generally comprises a housing 12. The housing 12 includes a back wall 14 and a perimeter wall 16 coupled to the back wall 14 of the housing 12. The back wall 14 of the housing 12 has a back surface 28. A distal edge 18 of the perimeter wall 16 relative to the back wall 14 defines an opening 20 into the housing 12. The housing 12 may insertably receive an electronic device 22. The electronic device 22 may be a Smart Phone of any conventional design or other similar electronic device. Additionally, a screen 23 on the electronic device 22 is accessible through the opening 20.

The housing 12 is structured to define a plurality of ducts 24 radiating outwardly from a central hub 25 on the back surface 28 of the back wall 14 of the housing 12. Each of the plurality of ducts 24 extends toward the perimeter wall 16 of the housing 12. The plurality of ducts 24 are in fluid communication with each other. Additionally, each of the plurality of ducts 24 extends forwardly on the perimeter wall 16 of the housing 12.

The plurality of ducts 24 each is open on the back wall 14 of the housing 12 to define a plurality of intakes 26. The plurality of intakes 26 each has an inner end 27 and an outer end 30. Each of the plurality of intakes 26 is elongated. A plurality of grills 32 is each coupled to an associated one of the plurality of intakes 26. The plurality of grills 32 completely covers each of the plurality of intakes 26.

Each of the plurality of ducts 24 open on the distal edge 18 of the perimeter wall 16 of the housing 12 to define a plurality of exhausts 34. The plurality of exhausts 34 on the distal edge 18 of the perimeter wall 16 of the housing 12 extends between each of the plurality of ducts 24. The plurality of exhausts 34 are evenly spaced apart and distributed around an entire perimeter of the distal edge 18 of the perimeter wall 16 of the housing 12.

A motor 36 is coupled to the housing 12. The motor 36 is positioned within a corner one 38 of the plurality of ducts 24. The motor 36 may be an electrical motor of any conventional design. A pair of fans 40 is coupled to the motor 36.

A compressor one 42 of the pair of fans 40 is rotatably coupled to the motor 36. The compressor fan 42 urges air inwardly through the plurality of intakes 26. The compressor fan 42 compresses the air as the air is drawn across the compressor fan 42. An expansion one 44 of the pair of fans 40 is rotatably coupled to the motor 36 and spaced apart from the compressor fan 42. The expansion fan 44 urges air outwardly through the plurality of exhausts 34. Additionally, the expansion fan 44 expands the compressed air as the air is drawn across the expansion fan 44.

A plurality of coils 46 is each positioned within an associated one of the plurality of exhausts 34. The plurality of coils 46 each extends between the second end 44 of the associated pair of ducts 40. Each of the plurality of coils 46 selectively heats or cools the air within the plurality of exhausts 34. A user 48 may manipulate a temperature of the air urged by the pair of fans 40. The plurality of coils may have an operational temperature ranging between 60° Fahrenheit and 80° Fahrenheit.

A power supply 50 is coupled to the housing 12. The power supply 50 is electrically coupled between the electronic device 22 and the motor 36 and the plurality of coils 46. The power supply 50 comprises at least one battery 52. A battery cover 54 is removably coupled to the central hub 25 of the plurality of ducts 24. The at least one battery 52 is positioned beneath the battery cover 54.

The power supply 50 is in electrical communication with the electronic device 22 when the electronic device 22 is positioned within the housing 12. The electronic device 22 contains a control program. The user 48 utilizes the control program to actuate the power supply 50, to control a speed of the motor 36 and to select a temperature range of the plurality of coils 46.

Alternatively, an aroma packet 56 is provided. The aroma packet 56 contains an aroma. The aroma may be an oil based aroma of any conventional design. The aroma packet 56 is removably coupled to the central hub of the plurality of ducts 24. Additionally, the aroma pack 56 is in fluid communication with the plurality of ducts 24.

A plurality of intake caps 58 is provided. Each of the plurality of intake caps 58 is removably coupled to an associated one of the plurality of ducts 24 to cover an associated one of the plurality of intakes 26. The plurality of intake caps 58 seals the associated one of the plurality of intakes 26. The compressor fan 42 draws the air inwardly through the aroma packet 56 so the aroma is released through the plurality of exhausts 34.

In use, the power supply 50 is actuated when the user 48 wishes to have a flow of air directed toward the user 48. The user 48 directs the plurality of exhausts 34 toward the user 48. Additionally, the user 48 may utilize the electronic device 22 simultaneously while utilizing the flow of air.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A personal cooling assembly comprising:

a housing comprising a back wall and a perimeter wall coupled to said back wall, a distal edge of said perimeter wall relative to said back wall defining an opening into said housing wherein said housing is configured to insertably receive an electronic device;

said housing being structured to define a plurality of ducts on said back wall of said housing, said plurality of ducts extending forwardly on said perimeter wall of said housing;

said plurality of ducts each being open on said back wall of said housing to define a plurality of intakes;

said plurality of ducts each being open on said distal edge of said perimeter wall of said housing to define a plurality of exhausts;

a motor coupled to said housing; and a fan coupled to said motor, said motor rotating said fan such that said fan urges air inwardly through said plurality of intakes and outwardly through said plurality of exhausts.

2. The personal cooling assembly according to claim 1, further comprising said back wall of said housing having a back surface, said plurality of ducts radiating outwardly from a central hub on said back surface of said back wall of said housing toward said perimeter wall of said housing such that said plurality of ducts are in fluid communication with each other.

3. The personal cooling assembly according to claim 2, further comprising said plurality of exhausts on said distal edge of said perimeter wall of said housing extending between each of said plurality of ducts such that said plurality of exhausts are evenly spaced apart and distributed around an entire perimeter of said distal edge of said perimeter wall of said housing.

4. The personal cooling assembly according to claim 1, further comprising said motor being positioned within a corner one of said plurality of ducts.

5. The personal cooling assembly according to claim 1, further comprising said fan being one of a pair of said fans.

6. The personal cooling assembly according to claim 5, further comprising a compressor one of said pair of fans being rotatably coupled to said motor such that said compressor fan urges air inwardly through said plurality of intakes.

7. The personal cooling assembly according to claim 6, further comprising an expansion one of said pair of fans being rotatably coupled to said motor and spaced apart from said compressor fan such that said expansion fan urges air outwardly through a plurality of exhausts.

8. The personal cooling assembly according to claim 1, further comprising a plurality of coils each positioned within an associated one of said plurality of exhausts such that said plurality of coils each extends along an entire length of said associated one of said plurality of exhausts.

9. The personal cooling assembly according to claim 8, further comprising each of said plurality of coils selectively heating or cooling the air within said plurality of exhausts such that a user may manipulate a temperature of the air urged by said fan.

10. The personal cooling assembly according to claim 1, further comprising a power supply coupled to said housing.

11. The assembly according to claim 10, further comprising said power supply being electrically coupled between the electronic device and said motor and a plurality of coils.

12. The assembly according to claim 11, further comprising said power supply comprising at least one battery.

13. A personal cooling assembly comprising:

a housing comprising a back wall and a perimeter wall coupled to said back wall, said back wall of said housing having a back surface, a distal edge of said perimeter wall relative to said back wall defining an opening into said housing wherein said housing is configured to insertably receive an electronic device;

said housing being structured to define a plurality of ducts radiating outwardly from a central hub on said back surface of said back wall of said housing toward said perimeter wall of said housing such that said plurality of ducts are in fluid communication with each other, said plurality of ducts extending forwardly on said perimeter wall of said housing;

said plurality of ducts each being open on said back wall of said housing to define a plurality of intakes;

said plurality of ducts each being open on said distal edge of said perimeter wall of said housing to define a plurality of exhausts;

said plurality of exhausts on said distal edge of said perimeter wall of said housing extending between each of said plurality of ducts such that said plurality of exhausts are evenly spaced apart and distributed around an entire perimeter of said distal edge of said perimeter wall of said housing;

a motor coupled to said housing such that said motor is positioned within a corner one of said plurality of ducts;

a fan coupled to said motor, said fan being one of a pair of fans;

a compressor fan of said pair of fans being rotatably coupled to said motor such that said compressor fan urges air inwardly through said plurality of intakes;

an expansion fan of said pair of fans being rotatably coupled to said motor and spaced apart from said compressor fan such that said expansion fan urges air outwardly through said plurality of exhausts;

a plurality of coils each positioned within an associated one of said plurality of exhausts such that said plurality of coils each extends between said second end of said associated pair of ducts, each of said plurality of coils selectively heating or cooling the air within said plurality of exhausts such that a user may manipulate a temperature of the air urged by said pair of fans; and a power supply coupled to said housing, said power supply being electrically coupled between the electronic device and said motor and said plurality of coils, said power supply comprising at least one battery.

* * * * *